US010651025B1

(12) United States Patent
Silveira et al.

(10) Patent No.: US 10,651,025 B1
(45) Date of Patent: May 12, 2020

(54) ORTHOGONAL-FLOW ION TRAP ARRAY

(71) Applicant: Thermo Finnigan LLC, San Jose, CA (US)

(72) Inventors: Joshua A. Silveira, San Jose, CA (US); Viatcheslav V. Kovtoun, Santa Clara, CA (US); Eloy R. Wouters, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/231,227

(22) Filed: Dec. 21, 2018

(51) Int. Cl.

| | |
|---|---|
| ***H01J 49/00*** | (2006.01) |
| ***H01J 49/42*** | (2006.01) |
| ***H01J 49/06*** | (2006.01) |
| ***H01J 49/40*** | (2006.01) |
| ***H01J 49/10*** | (2006.01) |

(52) U.S. Cl.
CPC ..... *H01J 49/4225* (2013.01); *H01J 49/068* (2013.01); *H01J 49/10* (2013.01); *H01J 49/401* (2013.01); *H01J 49/427* (2013.01); *H01J 49/4295* (2013.01)

(58) Field of Classification Search
CPC .. H01J 49/00; H01J 49/02; H01J 49/06; H01J 49/062; H01J 49/065; H01J 49/066; H01J 49/26; H01J 49/4225
USPC ..... 250/281, 282, 292
See application file for complete search history.

(56) References Cited

U.S. PATENT DOCUMENTS

| | | | | |
|---|---|---|---|---|
| 6,838,662 | B2 | 1/2005 | Bateman et al. | |
| 7,514,673 | B2 | 4/2009 | Senko et al. | |
| 7,838,826 | B1 * | 11/2010 | Park | G01N 27/622 250/281 |
| 7,872,228 | B1 | 1/2011 | Kim et al. | |
| 7,919,747 | B2 | 4/2011 | Green et al. | |
| 8,581,177 | B2 | 11/2013 | Kovtoun | |
| 8,809,769 | B2 | 8/2014 | Park | |
| 9,184,039 | B2 | 11/2015 | Pringle et al. | |
| 9,304,106 | B1 * | 4/2016 | Park | H01J 49/06 |
| 9,536,721 | B2 | 1/2017 | Berdnikov et al. | |
| 9,880,129 | B2 | 1/2018 | Bateman | |
| 2009/0302209 | A1 * | 12/2009 | Green | H01J 49/065 250/282 |
| 2012/0273673 | A1 * | 11/2012 | Park | G01N 27/624 250/283 |

(Continued)

FOREIGN PATENT DOCUMENTS

| | | | |
|---|---|---|---|
| WO | 2018/138484 | A1 | 8/2018 |

OTHER PUBLICATIONS

Chernushevich et al., "A W-Geometry Ortho-TOF MS with High Resolution and Up to 100% Duty Cycle for MS/MS", J Am Soc Mass Spectrom. (2017), 28, pp. 2143-2150.

(Continued)

*Primary Examiner* — Jason L McCormack
(74) *Attorney, Agent, or Firm* — David A. Schell

(57) ABSTRACT

An ion separation device comprising a plurality of electrodes arranged in a two-dimensional grid, a gas supply configured to provide a gas flow along the first direction, and an ion inlet arranged to receive ions. The plurality of electrodes is configured to create one or more pseudopotential barriers of increasing magnitude along a first direction. A drag force is applied to the ions by the gas flow is opposed by a pseudopotential gradient of the plurality of electrodes.

29 Claims, 13 Drawing Sheets

(56) References Cited

U.S. PATENT DOCUMENTS

2012/0273674 A1* 11/2012 Park ..... G01N 27/626 250/288
2013/0187044 A1* 7/2013 Ding ..... H01J 49/065 250/292
2013/0214149 A1 8/2013 Giles et al.
2014/0061457 A1* 3/2014 Berdnikov ..... H01J 49/0095 250/281
2014/0374590 A1* 12/2014 Park ..... G01N 27/622 250/282
2015/0364305 A1* 12/2015 Wang, Jr. ..... H01J 49/0036 250/282
2016/0126077 A1* 5/2016 Brown ..... H01J 49/0072 250/283
2019/0057852 A1* 2/2019 Ibrahim ..... G01N 27/622

OTHER PUBLICATIONS

Loboda et al., "A Novel Ion Trap That Enables High Duty Cycle and Wide m/z Range on an Orthogonal Injection TOF Mass Spectrometer", J Am Soc Mass Spectrom 2009, 20, pp. 1342-1348.
Webb et al., "Mobility-Resolved Ion Selection in Uniform Drift Field Ion Mobility Spectrometry/Mass Spectrometry: Dynamic Switching in Structures for Lossless Ion Manipulations", Anal. Chem. 2014, 86, pp. 9632-9637.
Allen et al., "Radio-Frequency (rf) Confinement in Ion MobilitySpectrometry: Apparent Mobilities and Effective Temperatures", J. Am. Soc. Mass Spectrom. (2016), vol. 27, pp. 2054-2063.
Kelly et al., "The Ion Funnel: Theory, Implementations and Applications", Mass Spectrometry Reviews, 2010, 29, pp. 294-312.
Nizamani et al., "Optimum electrode configurations for fast ion separation in microfabricated surface ion traps", Appl Phys B (2012), vol. 106, pp. 327-338.

* cited by examiner

ORTHOGONAL-FLOW ION TRAP ARRAY

FIELD

The present disclosure generally relates to the field of mass spectrometry including orthogonal-flow ion trap arrays.

INTRODUCTION

Filtering type mass spectrometry devices, such as quadrupole mass spectrometers, suffer from reduced efficiency (duty cycle) because they transmit ions of a single m/z ratio at a time while the rest are wasted. When performing an analysis of a complex sample, multiple analytes (N) can be targeted simultaneously by switching between ions and the duty cycle is limited to 1/N. Accumulating a broad range of ions in a trap and selectively ejecting them based on m/z to a quadrupole has the potential to avoid losing or missing ions while the quadrupole is analyzing only one m/z target at a time. However, mass resolving ion traps are limited to the analysis of between about $10^7$ to about $10^9$ ions per second, which is significantly below the brightness of existing ion sources, which can generate about $10^{10}$ ions per second or more. As such, the potential gains would be negated by the inability to handle the entire ion source current, as compared to a normal flow-through regime with the quadrupole cycling between m/z ratios.

Additionally, tandem mass spectrometry, referred to as MS/MS, is a widely-used analytical technique whereby precursor ions derived from a sample are subjected to fragmentation under controlled conditions to produce product ions. The product ion spectra contain information that is useful for structural elucidation and for identification of sample components with high specificity. Ion traps and quadrupoles can be employed to select m/z-grouped precursor ions for fragmentation and analysis of the fragment ions.

From the foregoing it will be appreciated that a need exists for improved systems and methods for separating ions prior to fragmentation and/or mass analysis.

SUMMARY

In a first aspect, an ion separation device can include a plurality of electrodes arranged in a two-dimensional grid, a gas supply configured to provide a gas flow along the first direction, and an ion inlet arranged to receive ions. The plurality of electrodes can be configured to create one or more pseudopotential barriers of increasing magnitude along a first direction. A drag force can be applied to the ions by the gas flow is opposed by a pseudopotential gradient of the plurality of electrodes.

In various embodiments of the first aspect, the ion inlet can be positioned to receive ions orthogonal to the first direction.

In various embodiments of the first aspect, the ion inlet can be positioned to receive ions aligned with the first direction.

In various embodiments of the first aspect, the plurality of electrodes can be further configured to receive RF voltages from an RF supply. In particular embodiments, the RF supply can be configured to supply RF voltages of increasing amplitude along the first direction.

In various embodiments of the first aspect, the spacing between electrodes in the first direction, the spacing between rows of the two-dimensional grid, the pitch of the electrodes, the width of the electrodes, or any combination thereof can change along the first direction to achieve the increasing magnitude of the pseudopotential barriers.

In various embodiments of the first aspect, an operating gas pressure can be between about $10^{-4}$ Torr and about $10^2$ Torr. In particular embodiments, the operating gas pressure can be between about 1 Torr and about 20 Torr. In other embodiments, the operating gas pressure can be between about $10^{-3}$ Torr and about 1 Torr.

In various embodiments of the first aspect, the ions can be continuously transmitted through the two-dimensional array.

In various embodiments of the first aspect, the ions can equilibrate within the ion separation device such that the ions migrate to a pseudopotential well where the pseudopotential barrier has a magnitude sufficient to trap the ions against the drag force generated from the gas flow.

In various embodiments of the first aspect, the ion separation device can further include guard electrodes configured to confine the ions and the gas flow within the two-dimensional array. In particular embodiments, the guard electrodes can be further configured to eject ions from the two-dimensional array in a direction parallel to a major axis of the electrodes and orthogonal to the gas flow by applying a DC pulse.

In various embodiments of the first aspect, the plurality of electrodes can be further configured to receive a DC voltage from a DC supply. In particular embodiments, the DC voltage can create a DC gradient to eject ions from the two-dimensional array.

In a second aspect, a mass spectrometer system can include an ion source configured to produce ions, an ion separation device, and a mass analyzer configured to measure a mass to charge ratio of the ions. The ion separation device can include a plurality of electrodes arranged in a two-dimensional grid, wherein the plurality of electrodes is configured to create one or more pseudopotential barriers of increasing magnitude along a first direction, a gas supply configured to provide a gas flow along the first direction, and an ion inlet arranged to receive the ions, wherein a drag force applied to the ions by the gas flow is opposed by a pseudopotential gradient of the plurality of electrodes.

In various embodiments of the second aspect, the ion inlet can be positioned to receive ions orthogonal to the first direction.

In various embodiments of the second aspect, the ion inlet can be positioned to receive ions aligned with the first direction.

In various embodiments of the second aspect, mass spectrometer system can further include an RF supply configured to provide RF voltages to the plurality of electrodes. In particular embodiments, the RF supply can be configured to supply RF voltages of increasing amplitude along the first direction.

In various embodiments of the second aspect, wherein the spacing between electrodes in the first direction, the spacing between rows of the two-dimensional grid, the pitch of the electrodes, the width of the electrodes or any combination thereof can change along the first direction to achieve the increasing magnitude of the pseudopotential barriers.

In various embodiments of the second aspect, an operating gas pressure within the ion separation device can be between about 10-4 Torr and about 102 Torr. In particular embodiments, the operating gas pressure can be between about 1 Torr and about 20 Torr. In other embodiments, the operating gas pressure can be between about 10-3 Torr and about 1 Torr.

In various embodiments of the second aspect, the ions can be continuously transmitted through the ion separation device.

In various embodiments of the second aspect, the ions can equilibrate within the ion separation device such that the ions migrate to a pseudopotential well where the pseudopotential barrier has a magnitude sufficient to trap the ions against the drag force generated from the gas flow.

In various embodiments of the second aspect, the ion separation device further includes guard electrodes configured to confine the ions and the gas flow within the two-dimensional array. In particular embodiments, wherein the guard electrodes are further configured to eject ions from the two-dimensional array in a direction parallel to a major axis of the electrodes and orthogonal to the gas flow by applying a DC pulse.

In various embodiments of the second aspect, the mass spectrometer system can further include a DC supply configured to provide a DC voltage to the plurality of electrodes. In particular embodiments, the DC supply can be configured to apply a DC gradient to eject ions from the two-dimensional array.

In a third aspect, a method of separating ions can include providing RF potentials to a plurality of electrodes arranged in a two-dimensional grid such that one or more pseudopotential barriers of increasing magnitude along a first direction; supplying a gas flow through the two-dimensional grid in the first direction; injecting ions into the two-dimensional grid; and separating the ions within the two-dimensional grid wherein a drag force applied by the gas flow is opposed by a pseudopotential gradient of the plurality of electrodes.

In various embodiments of the third aspect, the method can further include equilibrating ions within the two-dimensional grid such that ions become trapped in one of the pseudopotential wells where the pseudopotential barrier has a magnitude sufficient to trap the ions against the drag force generated from the gas flow.

In various embodiments of the third aspect, the method can further include maintaining an operating gas pressure within the two-dimensional grid of between about 10-4 Torr and about 102 Torr. In particular embodiments, the operating gas pressure can be between about 10-3 Torr and about 1 Torr. In other embodiments, the operating gas pressure within the two-dimensional grid can be between about 1 Torr and about 20 Torr.

In various embodiments of the third aspect, the drag force can be a function of the collisional cross section of the ions.

In various embodiments of the third aspect, the gas velocity can be between about 10 m/s and about 200 m/s.

In various embodiments of the third aspect, the pseudopotential barrier can be a function of the mass-to-charge ratio.

In various embodiments of the third aspect, movement of the ions through the two-dimensional grid can be a function of collisional cross section and mass-to-charge ratio. In particular embodiments, movement of the ions through the two-dimensional grid can be further dependent upon a gas velocity and a gas viscosity.

In various embodiments of the third aspect, injecting the ion can include injecting the ions in a path that is orthogonal to the first direction.

In various embodiments of the third aspect, injecting the ion can include injecting the ions in a path that is aligned with to the first direction.

In various embodiments of the third aspect, the method can further include ejecting the ions from the two-dimensional grid in a direction parallel to a major axis of the electrodes and orthogonal to the gas flow. In particular embodiments, ejecting the ions can include ejecting the ions substantially simultaneously from two or more the plurality of pseudopotential wells.

In various embodiments of the third aspect, the method can further include ejecting the ions from the two-dimensional grid along the first direction.

DRAWINGS

For a more complete understanding of the principles disclosed herein, and the advantages thereof, reference is now made to the following descriptions taken in conjunction with the accompanying drawings, in which.

Figure 1:
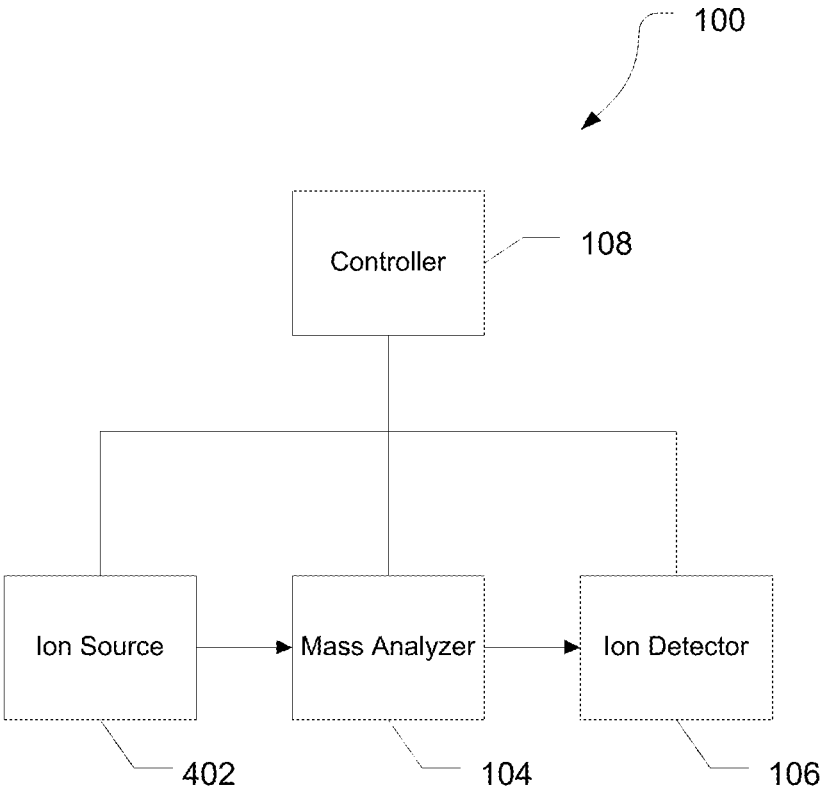
FIG. 1 is a block diagram illustrating an exemplary mass spectrometry system.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for transporting ions are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, inductively coupled plasma (ICP) source, electron ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a time-of-flight (TOF) analyzer, a quadrupole ion trap analyzer, an electrostatic trap mass analyzer (such as an ORBITRAP mass analyzer), and the like. In various embodiments, the mass analyzer 104 can also be configured to fragment the ions and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configured the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Figure 2A:
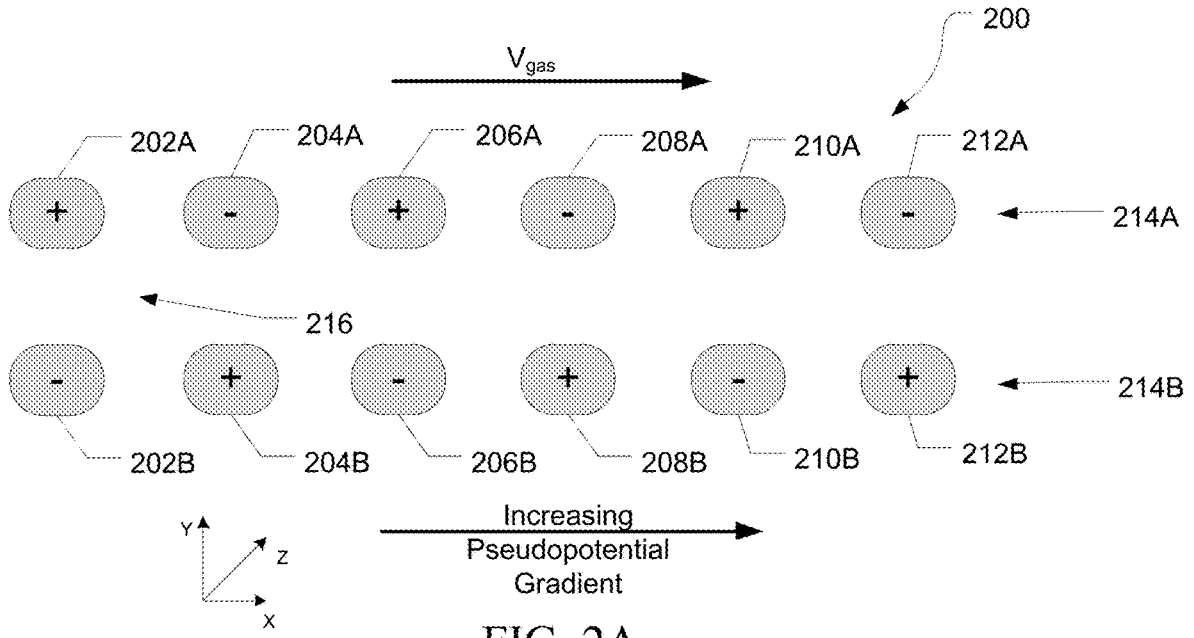
FIGS. 2A and 2B are diagrams illustrating an exemplary orthogonal flow ion trap array, in accordance with various embodiments.
Figure 2B:
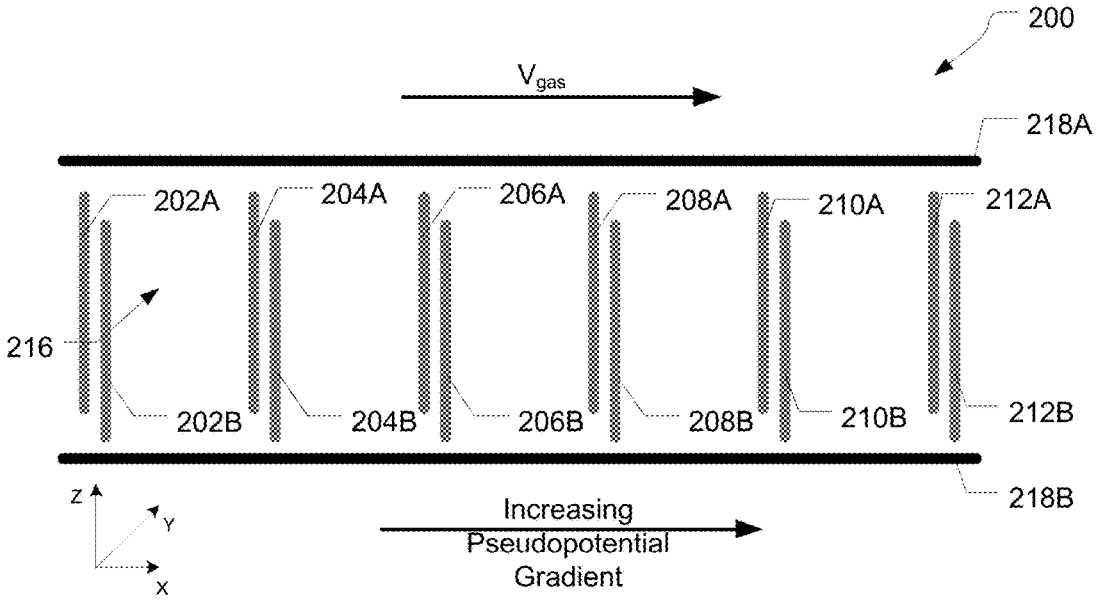

Various embodiments of mass spectrometry system 100 can include an orthogonal-flow ion trap array 200 as illustrated in the block diagram of FIGS. 2A and 2B. The orthogonal-flow ion trap array 200 can include a plurality of electrodes 202A-212A and 202B-212B. The electrodes can be arranged in a two-dimensional grid, such that electrodes 202A-212A form a first row of electrodes 214A and electrodes 202B-212B form a second row of electrodes 214B parallel and aligned with the first row of electrodes 214A. Each rectangular arrangement of four adjacent electrodes, such as 202A, 202B, 204A, and 204B, can behave as an ion trap, trapping ions in the space 216 between the electrodes using a pseudopotential well. To achieve this, an RF potential can be applied to each of the electrodes with alternating polarity, such that the polarity of electrodes 202A and 204B are opposite of the polarity of 202B and 204A, as indicated by the '+' and '−' symbols in FIG. 2.

In various embodiments, rows 214A and 214B can extend in a first direction (X), rows 214A and 214B can be spaced apart from one another in a second direction (Y), and the electrodes can extend in a third direction (Z). In various embodiments, guard electrodes 218A and 218B can be positioned at each end of the plurality of electrodes 202A-212A and 202B-212B. A DC voltage can be applied to the guard electrodes 218A and 218B to confine the ions in the Z direction. In alternate embodiments, each of the plurality of electrodes can be segmented (not shown) and DC potentials can be applied to each segment to confine the ions in the Z direction. Additionally, changes to the DC voltages can be used to eject ions in the Z direction. The ions can be ejected simultaneously from multiple pseudopotential wells. Alternatively, the pseudopotential wells can be individually addressed either with segmented electrodes 202A-212A and 202B-212B or by segmenting the guard electrodes 218A and 218B.

Figure 3:
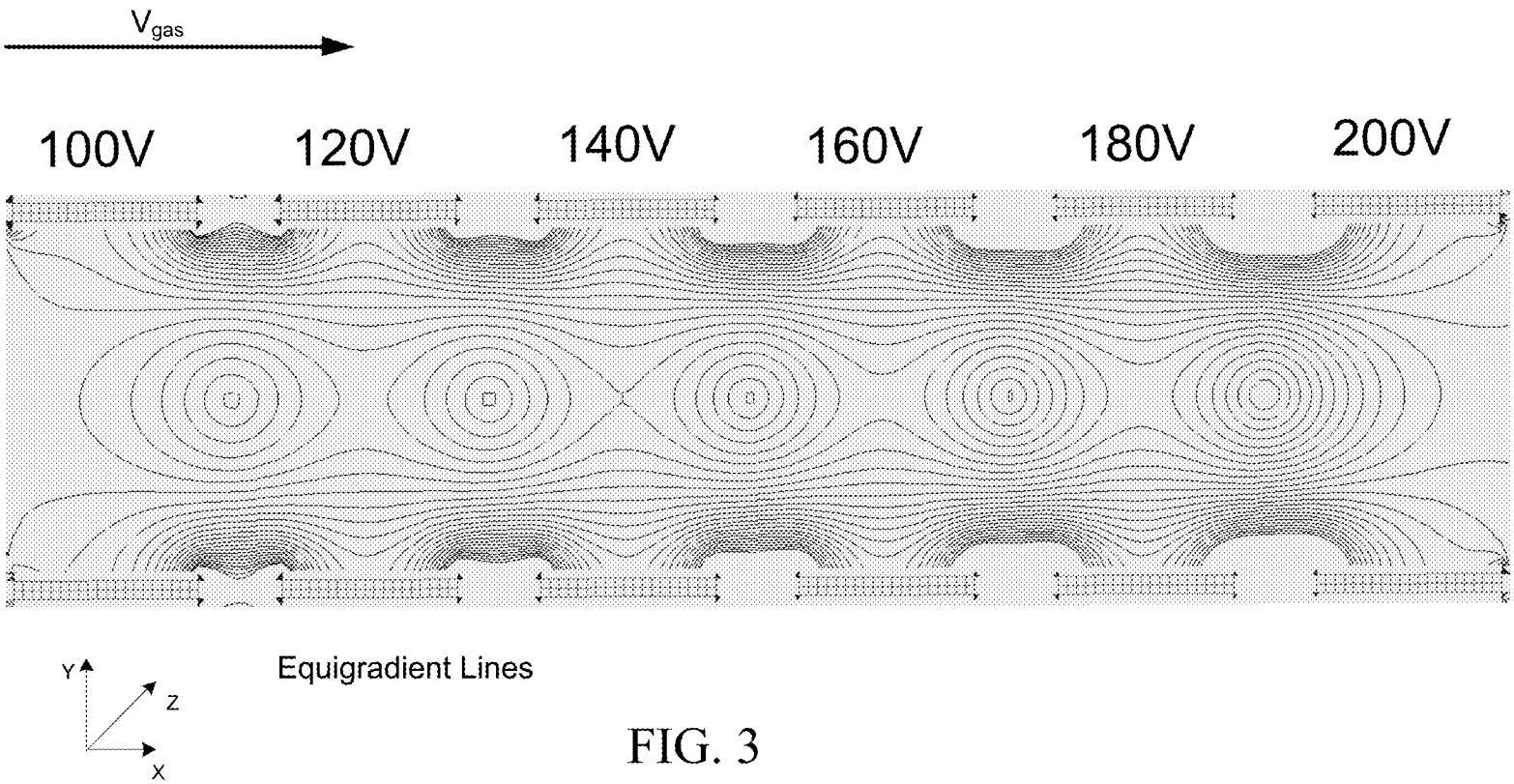
FIGS. 3 and 4 are plots showing the pseudopotential gradient for an orthogonal flow ion trap array, in accordance with various embodiments.
Figure 4:
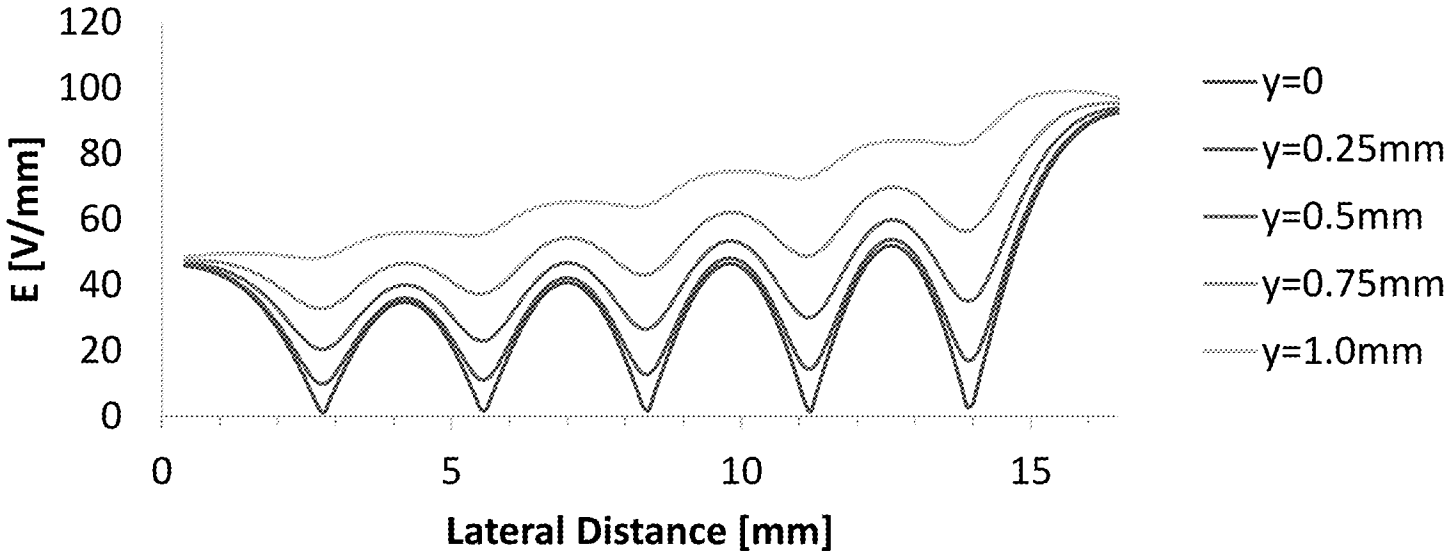

In various embodiments, the amplitude of the RF potentials applied to the electrodes can increase along the direction of gas flow (X direction). Specifically, the RF amplitude of electrode 212A>210A>208A>206A>204A>202A. FIG. 3 is an illustration of the equigradient field lines and FIG. 4 is an illustration of the RF electric field along the length of an exemplary device. The RF amplitude of the first electrode pair is 100V with the RF amplitude increasing by 20V for each successive electrode pair until the RF amplitude of the final electrode pair being 200V. As can be seen in FIG. 4, even though the well minima are substantially the same (approximately 0 V/mm, each successive local maximum (height of the RF electric field barrier) increases along the X direction.

In various embodiments, the electrode can have a planar electrode geometry to allow for a non-turbulent laminar gas flow to propagate across the entire channel.

In alternate embodiments, the RF amplitude can be constant along the X direction but the electrode geometry can change, such as by altering the spacing in the X and/or Y directions, to achieve the increasing pseudopotential barrier.

The pseudopotential barrier can result in a force on the ions that pushes in the negative X direction. The pseudopotential is both a function of mass-to-charge ratio (m/z) of the ion and the amplitude of the RF voltage ($V_{RF}$). The pseudopotential, V*, can be defined according to Equation 1 where z is the ion charge state, e is the elementary charge, $E_{RF}$ is the RF electric field, and w is the angular RF frequency.

$$V^*=eE_{RF}^2/(4(m/z)\omega^2) \quad \text{Equation 1}$$

The interaction of the ions with the gas flow can result in a drag force that acts to move the ions in the positive X direction. The drag force is related to collisional cross section or projection area A, and is a function of the gas number density n, the molecular mass of the gas $m_2$, and the particle velocity v.

$$F_{Drag} = -\frac{1}{2}C_D A n m_2 v^2 \quad \text{Equation 2}$$

In the context of ion mobility, the drag force is proportional to the ratio of the gas velocity to the mobility coefficient K. Both expressions follow a similar form since the cross section is proportional to z/K.

$$F_{Drag}=zev_{gas}/K \quad \text{Equation 3}$$

In a quadrupolar field, ions are confined radially in a pseudopotential well, such as at 216. Using a gas flow, ions of low mobility can be forced across the pseudopotential barrier from one well to the next. Because Equation 3 shows that the drag force exerted on ions of low mobility is greater, these ions can be forced further up the confining potential. It is important to note that ions of low mobility can experience not only a greater drag force, but can be trapped by lower pseudopotential barriers. Together, these factors can allow for ions of high m/z and/or low K ions to overcome the pseudopotential barriers and move laterally into an adjacent well in the trap. Importantly, the magnitude of the pseudopotential barriers can increase laterally as a result of increasing the RF voltage or changing geometry. This can allow high m/z and/or low K ions to eventually become confined when the drag force cannot overcome the confining potential. This can also allow for better confinement of high mass ions by increasing their q, stability parameter. Conversely, ions of high mobility may not be as affected by the gas flow and thus, may not migrate laterally or may migrate laterally to a lesser extent.

Figure 5:
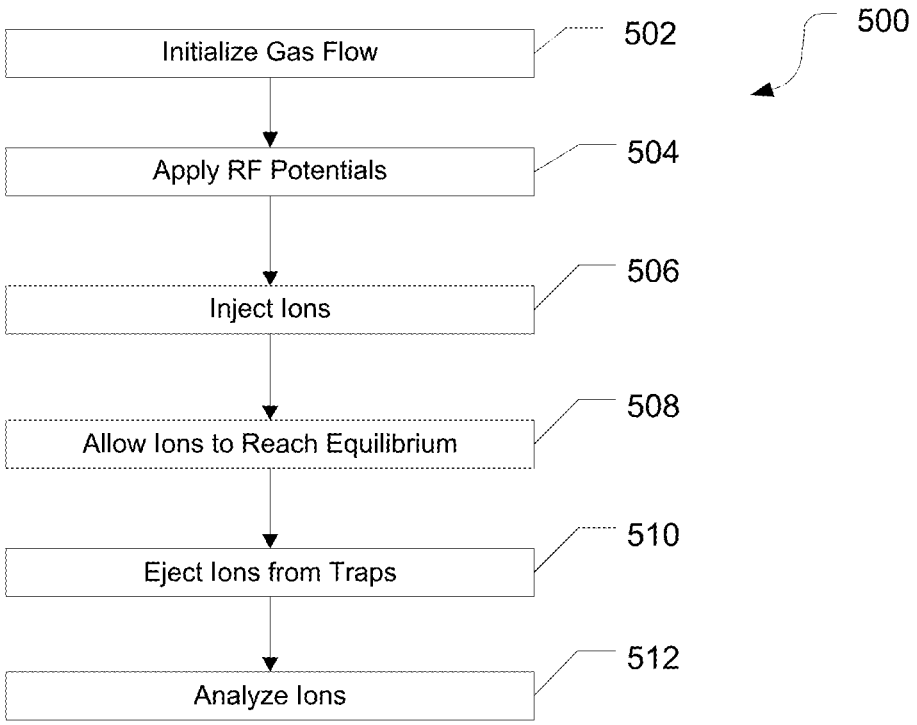
FIG. 5 is a flow diagram illustrating an exemplary method of separating ions using an orthogonal flow ion trap array, in accordance with various embodiments.

FIG. 5 is a flow diagram illustrating a method 500 for separating ions according to the principles discussed. At 502, gas flow through an orthogonal-flow ion trap array can be initialized. In various embodiments, the gas pressure within the orthogonal-flow ion trap array can be maintained between about $10^{-4}$ Torr and about $10^2$ Torr, such as between about 1 Torr and about 20 Torr. The gas velocity can be maintained between about 10 m/s and about 200 m/s. At 504, RF potentials can be applied to the electrodes. In particular, the RF amplitudes of the electrodes can increase along the direction of the gas flow. In various embodiments, the gas flow and the RF amplitudes can be adjusted based on the mobility coefficient and m/z for the ions of interest.

At 506, the ions can be injected into the orthogonal flow ion trap array. In various embodiments, the ions can be injected into the trap array as an ion packet rather than as a continuous stream of ions. In various embodiments, the ions can be injected into the first ion trap in a direction parallel to the electrodes and perpendicular to the gas flow.

At 508, a time delay can allow the ions to reach an equilibrium position. In various embodiments, the time delay can be not greater than about 1000 milliseconds. Although, a shorter time delay can be desirable when separating ions with the larger m/z.

In various embodiments, the equilibration time can be influenced by the RF voltage increase as a function of the lateral position. The simulations contained in FIGS. 9A-9I utilize a linear RF voltage increase which produces a trapping potential that increases with the square of distance. Varying the pseudopotential profile as a function of position can allow for the relative separation timescale to be adjusted, and can also allow for the charge capacity in each well to be altered. Another means for changing the separation timescale may involve changing the geometry of the device. Geometry changes may include changing the height of the trap and/or changing the height along the separation dimension (i.e.: placing the two planes of the array at a small angle with respect to one another), changing the width and spacing of the electrodes, varying the height along the axial direction to speed up ejection from the trap, or any combination thereof.

At 510, the ions can be ejected from the traps. In various embodiments, the ions can be ejected in a direction parallel to the electrodes and perpendicular to the gas flow. In various embodiments, the ions can be ejected from a trap by applying a DC gradient or DC pulse. This can be accomplished by lowering the DC potential of one of the end electrodes and/or raising the DC potential of the other end electrode. Alternatively, when using a segmented electrode, a DC gradient can be applied to the segmented electrode by applying a high voltage to the segment on one end and a lower voltage to a segment on the other end of the electrode. In various embodiments, the ions can be ejected from the traps of the orthogonal flow ion trap array substantially simultaneously, such as into a storage cell array. When using a storage cell array, the ions can be temporarily stored and each individual ion packet can be released and analyzed sequentially. At 512, the ions can be analyzed.

Figure 6:
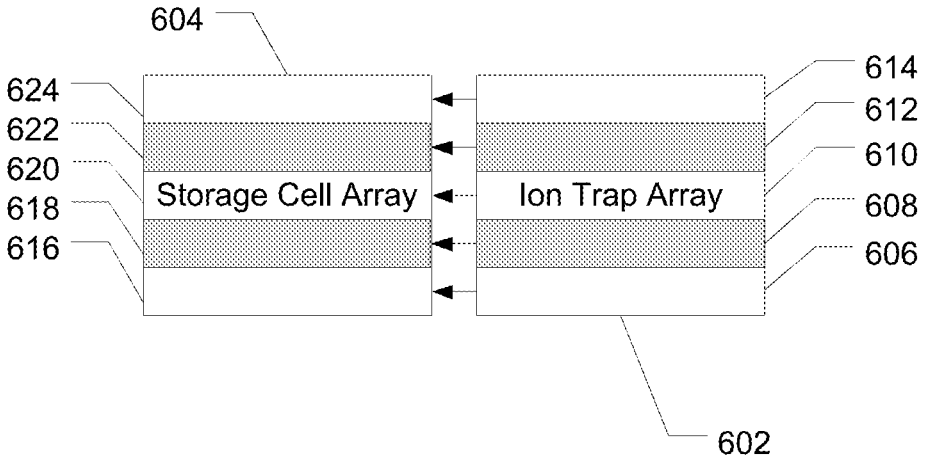
FIG. 6 is a block diagram illustrating an exemplary embodiment of an orthogonal flow ion trap array coupled to a storage cell array, in accordance with various embodiments.

In various embodiments, the orthogonal flow ion trap array can be used in conjunction with a storage cell array. FIG. 6 is a block diagram illustrating an orthogonal flow ion trap array 602 coupled to a storage cell array 604. Ion trap array 602 can include a plurality of well locations 606, 608, 610, 612, and 614 which can be aligned to a plurality of storage cells 616, 618, 620, 622, and 624 of storage cell array 604. Ions can enter into ion trap array and can migrate to different well locations depending on their mobility coefficient and m/z. The ions can be transferred from the well locations 606, 608, 610, 612, and 614 to the corresponding storage cells. In various embodiments, the ions from multiple wells can be transferred at substantially the same time. Alternatively, ions from the wells can be transferred independently. In various embodiments, the ions can be stored in the storage cell array awaiting further analysis. For example, each storage cell can be individually accessed to analyze the ions contained therein.

In various embodiments, different ion species can have different abundance in the sample, such that a first well include one or more low abundance ion species while a second well can include a higher abundance ion species. Using the storage cell to accumulate ions and different numbers of transfers depending on the well can compensate for the initial differences in ion abundance. For example, the high abundance ion of the second well can substantially fill the corresponding cell of the storage cell array in one or two cycles while the low abundance ions of the first well may take more cycles to reach the capacity of the corresponding cell of storage cell array. The system can reduce the number of accumulations for the second well while increasing the number of accumulations for the first well.

Figure 7:
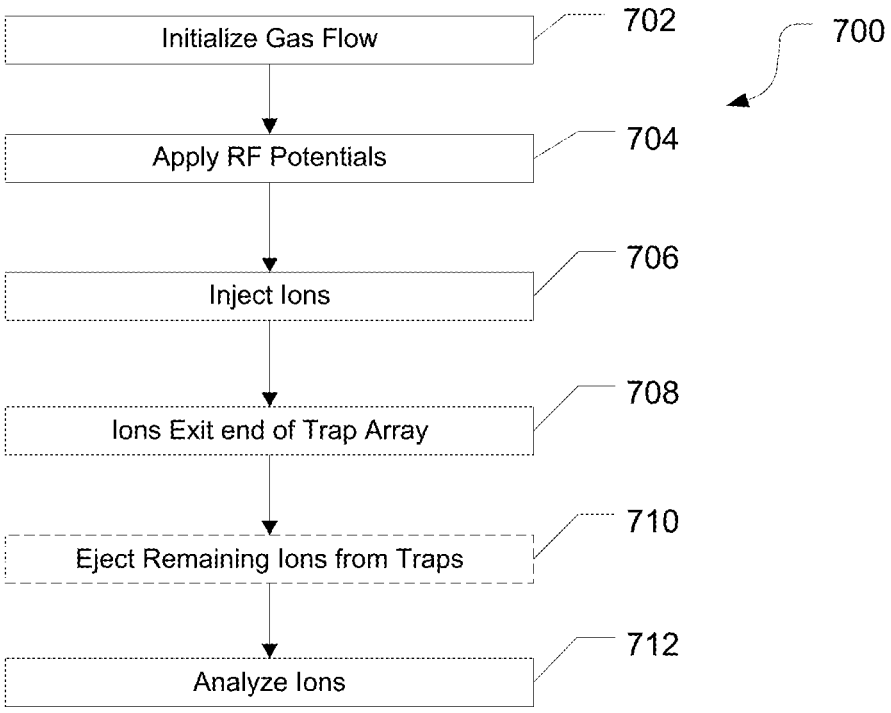
FIG. 7 is a flow diagram illustrating another exemplary method of separating ions using an orthogonal flow ion trap array, in accordance with various embodiments.

FIG. 7 is a flow diagram illustrating a method 700 for separating ions according to the principles discussed. At 702, gas flow through an orthogonal-flow ion trap array can be initialized. In various embodiments, the gas pressure within the orthogonal-flow ion trap array can be maintained between about $10^{-4}$ Torr and about $10^{2}$ Torr, such as between about $10^{-3}$ Torr and about 1 Torr. At 704, RF potentials can be applied to the electrodes. In particular, the RF amplitudes of the electrodes can increase along the direction of the gas flow. In various embodiments, the gas flow and the RF amplitudes can be adjusted based on the mobility coefficient and m/z for the ions of interest.

At 706, the ions can be injected into the orthogonal flow ion trap array. In various embodiments, the ions can be injected into the trap array as an ion packet rather than as a continuous stream of ions. In various embodiments, the ions can be injected into the first ion trap in a direction parallel to the electrodes and perpendicular to the gas flow.

At 708, the ions moving along the length of the trap array and exit with the gas flow. In various embodiments, the gas flow may be large enough that the ions are not trapped by the increasing pseudopotential barrier, but rather differentially slowed. Ions with a larger mobility coefficient and/or a larger m/z may leave the trap array first and other ions with a smaller mobility coefficient and/or smaller m/z may leave the trap later (with a greater delay). The ions exiting the trap array can then be focused and directed for further processing.

Optionally, at 710, any remaining ions can be ejected from the traps. In various embodiments, the ions can be ejected in a direction parallel to the electrodes and perpendicular to the gas flow. In various embodiments, the ions can be ejected from a trap by applying a DC gradient or DC pulse. This can be accomplished by lowering the DC potential of one of the end electrodes and/or raising the DC potential of the other end electrode. Alternatively, when using a segmented electrode, a DC gradient can be applied to the segmented electrode by applying a high voltage to the segment on one end and a lower voltage to a segment on the other end of the electrode. Alternatively, the ions can be ejected from the traps radially.

At 712, the ions can be analyzed.

Computer-Implemented System

Figure 8:
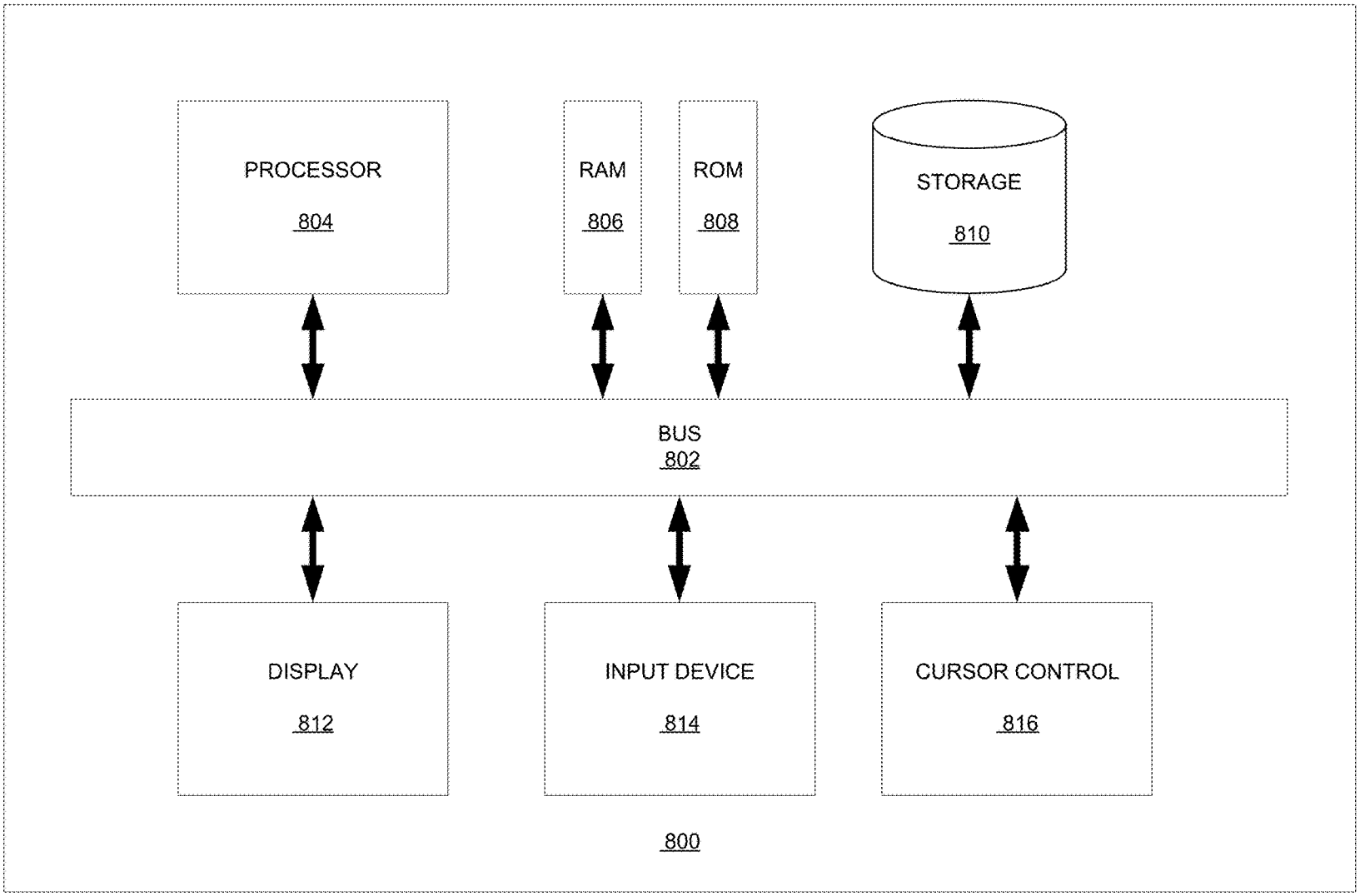
FIG. 8 is a block diagram illustrating an exemplary computer system, in accordance with various embodiments.

FIG. 8 is a block diagram that illustrates a computer system 800, upon which embodiments of the present teachings may be implemented as which may form all or part of controller 108 of mass spectrometry platform 100 depicted in FIG. 1. In various embodiments, computer system 800 can include a bus 802 or other communication mechanism for communicating information, and a processor 804 coupled with bus 802 for processing information. In various embodiments, computer system 800 can also include a memory 806, which can be a random access memory (RAM) or other dynamic storage device, coupled to bus 802 for determining base calls, and instructions to be executed by processor 804. Memory 806 also can be used for storing temporary variables or other intermediate information during execution of instructions to be executed by processor 804. In various embodiments, computer system 800 can further include a read only memory (ROM) 808 or other static storage device coupled to bus 802 for storing static information and instructions for processor 804. A storage device 810, such as a magnetic disk or optical disk, can be provided and coupled to bus 802 for storing information and instructions.

In various embodiments, computer system 800 can be coupled via bus 802 to a display 812, such as a cathode ray tube (CRT) or liquid crystal display (LCD), for displaying information to a computer user. An input device 814, including alphanumeric and other keys, can be coupled to bus 802 for communicating information and command selections to processor 804. Another type of user input device is a cursor control 816, such as a mouse, a trackball or cursor direction keys for communicating direction information and command selections to processor 804 and for controlling cursor movement on display 812. This input device typically has two degrees of freedom in two axes, a first axis (i.e., x) and a second axis (i.e., y), that allows the device to specify positions in a plane.

A computer system 800 can perform the present teachings. Consistent with certain implementations of the present teachings, results can be provided by computer system 800 in response to processor 804 executing one or more sequences of one or more instructions contained in memory 806. Such instructions can be read into memory 806 from another computer-readable medium, such as storage device 810. Execution of the sequences of instructions contained in memory 806 can cause processor 804 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 804 for execution. Such a medium can take many forms, including but not limited to, non-volatile media, volatile media, and transmission media. Examples of non-volatile media can include, but are not limited to, optical or magnetic disks, such as storage device 810. Examples of volatile media can include, but are not limited to, dynamic memory, such as memory 806. Examples of transmission media can include, but are not limited to, coaxial cables, copper wire, and fiber optics, including the wires that comprise bus 802.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, G, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

Results

Figure 9A:
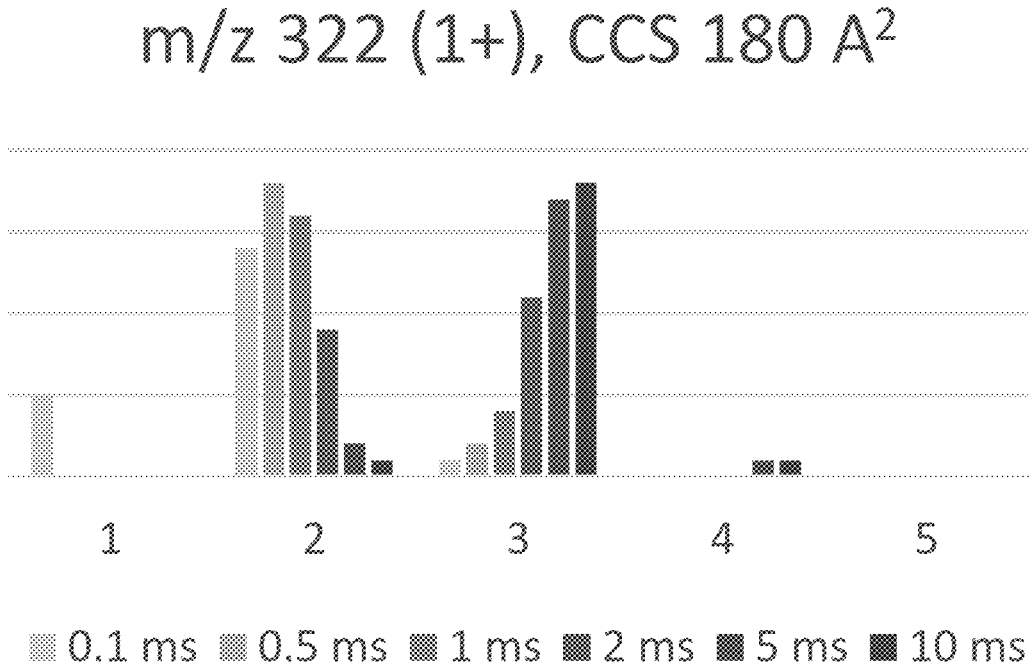
FIGS. 9A-9I illustrate the results of simulations of the behavior of ions within an exemplary orthogonal flow ion trap array.
Figure 9B:
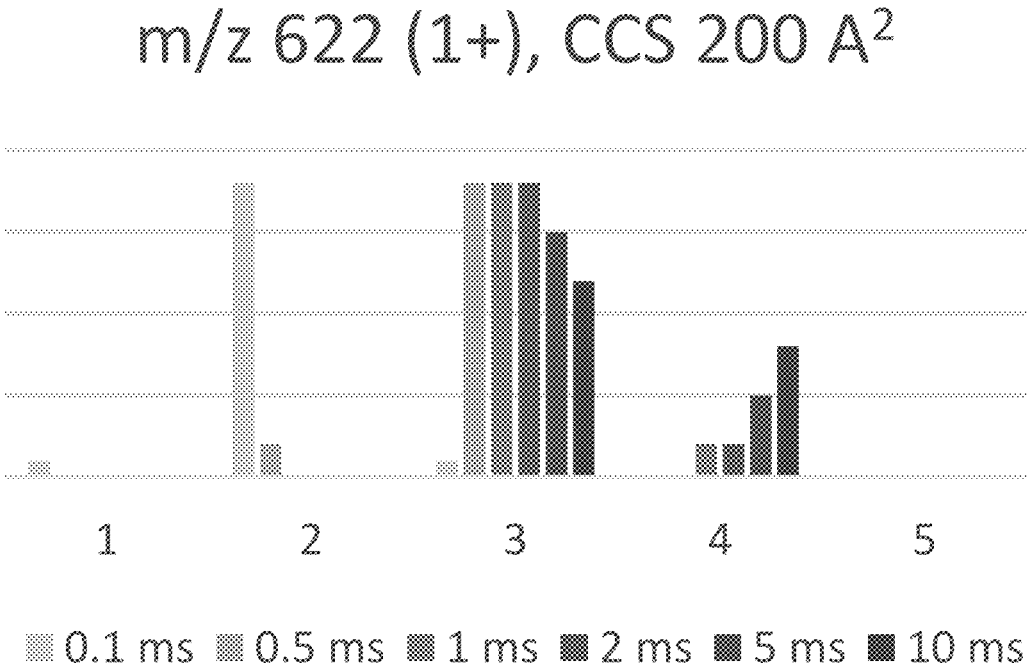
Figure 9C:
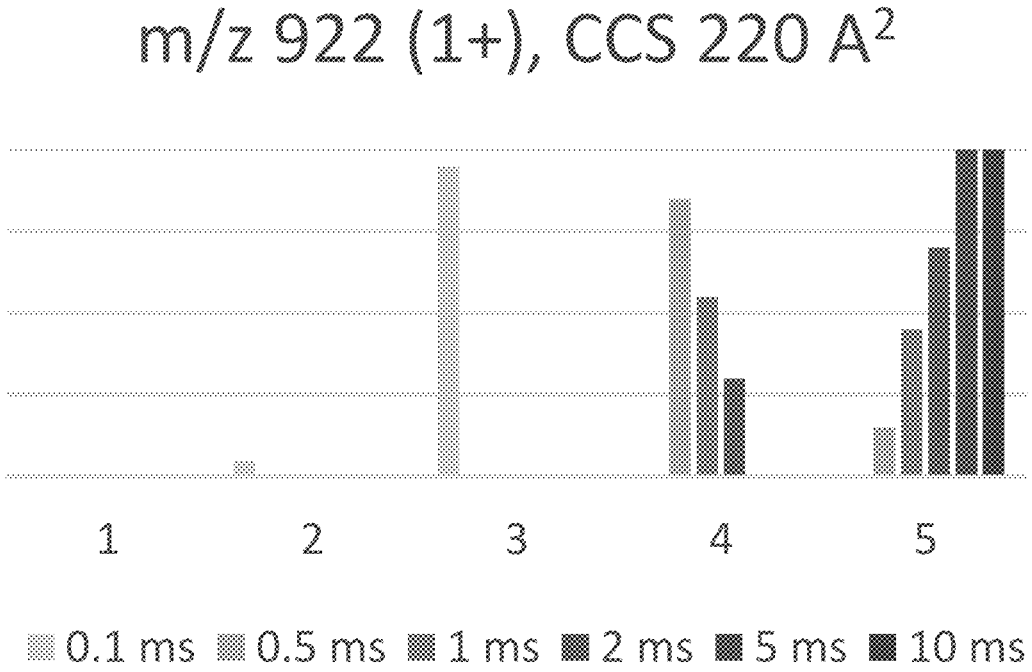
Figure 9D:
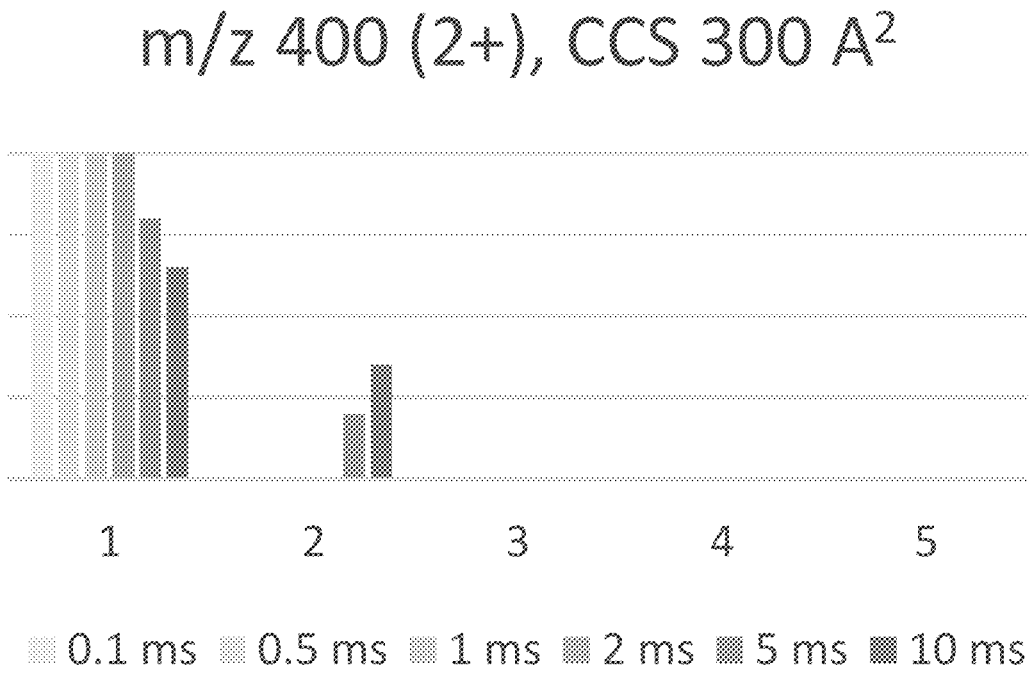
Figure 9E:
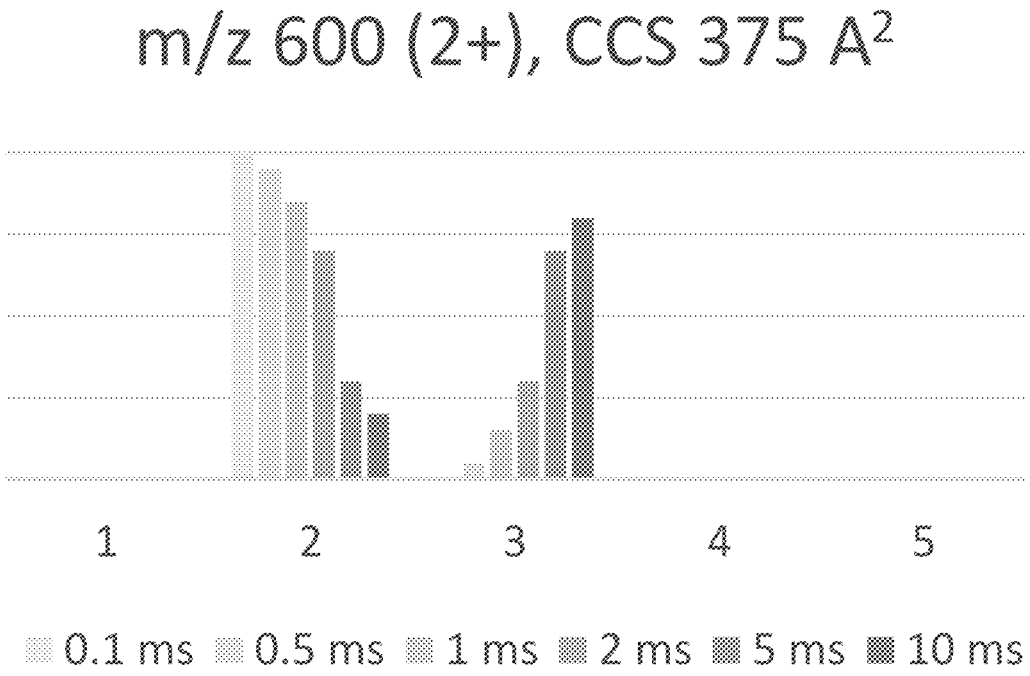
Figure 9F:
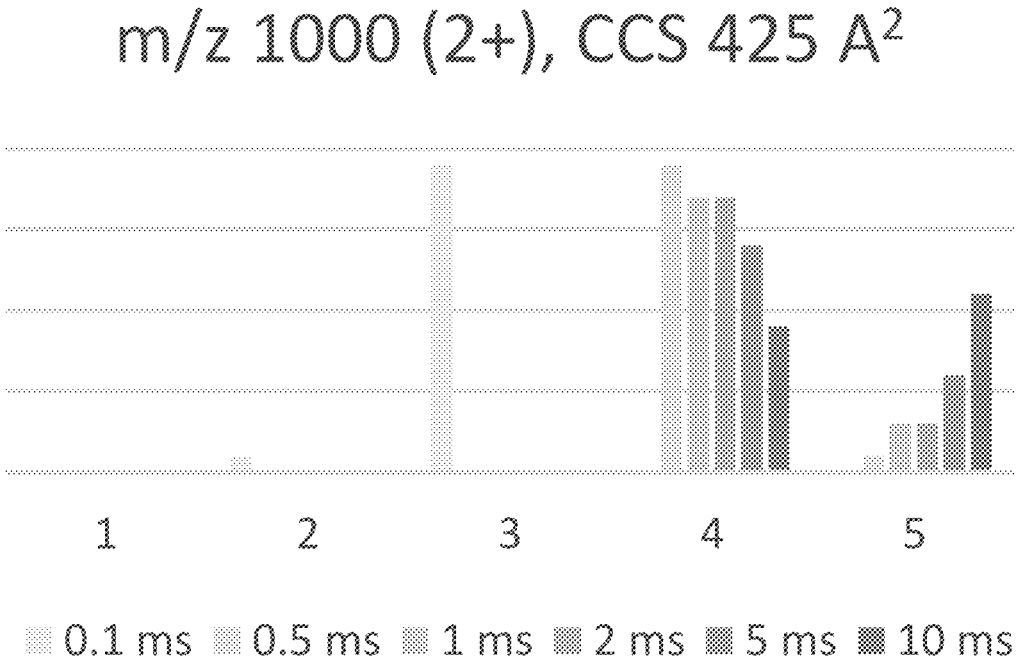
Figure 9G:
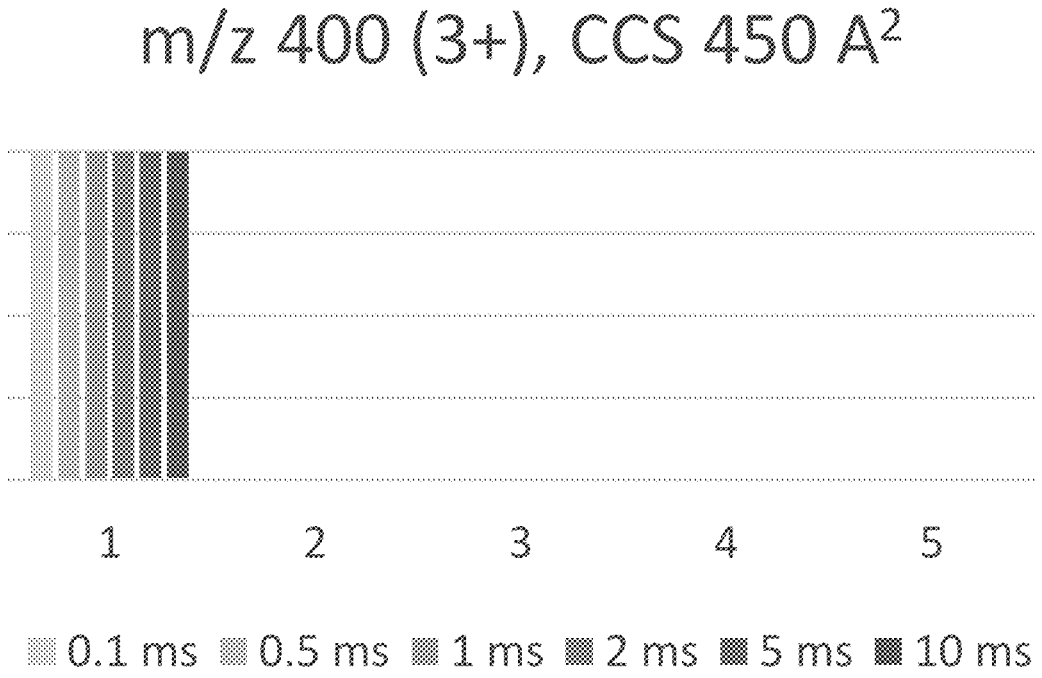
Figure 9H:
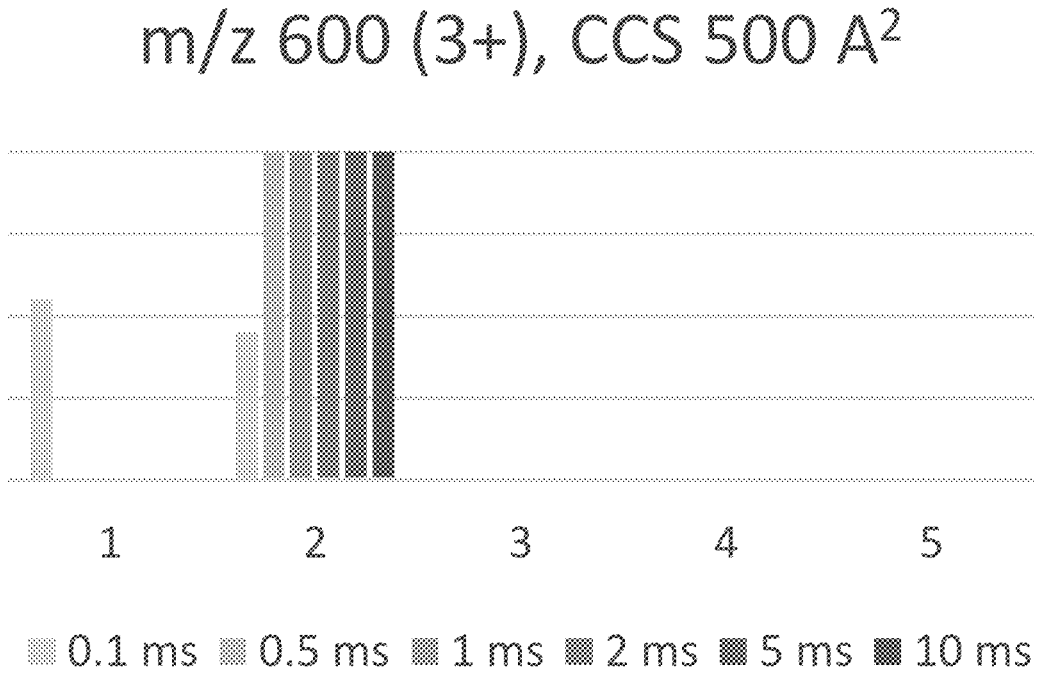
Figure 9I:
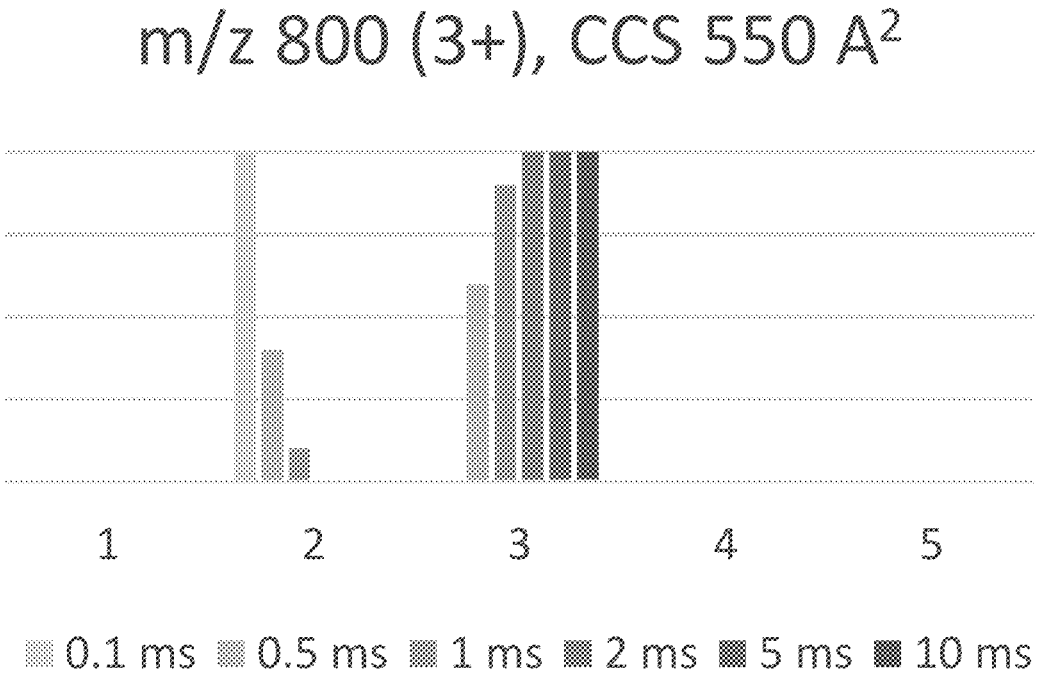

FIGS. 9A-9C contain simulations of individual trajectories of singly charged ions differing in m/z and collision cross section (CCS) in units of square Angstroms ($A^2$). The simulations were performed at ambient temperature and 1 Torr nitrogen. The RF frequency was 1 MHz and the gas velocity was 100 m/s. DC guard electrodes, biased 5 V above the rod potential, were used to generate axial confinement. In each case, ions enter the trap in the well located on the left side. Low m/z ions (i.e.: m/z 322) are temporarily confined in the second well, though eventually, the force of the gas pushes ions into the third well where a majority of the population reaches an equilibrium position after 5 ms. The simulation shows that m/z 622 can more easily overcome the second pseudopotential barrier and reach an equilibrium position in the third and fourth well owing to the decreased well depth and increased drag force. Results for m/z 922 further demonstrate the separation principles as these ions are retained in the fifth well. Ultimately, ions are dispersed according to their mass and mobility properties in different wells within the trap. It is noteworthy that the applied voltage in the simulation was not sufficient to retain higher mass ions such as m/z 2122 in the trap given the pressure and gas velocity. However, decreasing the pressure, decreasing the gas velocity magnitude, and/or increasing the RF voltage can result in retention of m/z 2122 (not shown) illustrating the ability to alter the inherent low K-high m/z cutoff. In principle, the low K-high m/z cutoff may be beneficial for removal of unwanted species from the ion beam.

FIGS. 9D-9I contains results from simulations involving multiply charged ions under the same conditions as in FIGS. 9A-9C. Note that at approximately the same m/z, singly charged ions have lower mobilities and thus, migrate laterally to a greater extent. This trend is further exemplified by doubly and triply charged forms of m/z 600. On the timescale of <10 ms, most of the m/z 600 population that is doubly charged is trapped in the third well whereas the m/z 600 population that is triply charged remains in the second well.

What is claimed is:

1. An ion separation device comprising:

a plurality of electrodes arranged in a two-dimensional grid, wherein the plurality of electrodes is configured to create pseudopotential barriers separating a plurality of pseudopotential wells, the pseudopotential barriers increasing in magnitude along a first direction;

a gas supply configured to provide a gas flow along the first direction; and an ion inlet arranged to receive ions, wherein a drag force applied to the ions by the gas flow is opposed by a pseudopotential gradient of the plurality of electrodes.

2. The ion separation device of claim 1, wherein the ion inlet is positioned to receive ions orthogonal to the first direction.

3. The ion separation device of claim 1, wherein the ion inlet is positioned to receive ions aligned with the first direction.

4. The ion separation device of claim 1, wherein the plurality of electrodes are further configured to receive RF voltages from an RF supply.

5. The ion separation device of claim 4, wherein the RF supply is configured to supply RF voltages of increasing amplitude along the first direction.

6. The ion separation device of claim 1, wherein the spacing between electrodes in the first direction, the spacing between rows of the two-dimensional grid, the pitch of the electrodes, the width of the electrodes, or any combination thereof changes along the first direction to achieve the increasing magnitude of the pseudopotential barriers.

7. The ion separation device of claim 1, wherein an operating gas pressure is between about $10^{-4}$ Torr and about $10^{2}$ Torr.

8. The ion separation device of claim 1, wherein the ions are continuously transmitted through the two-dimensional array.

9. The ion separation device of claim 1, wherein the ions equilibrate within the ion separation device such that the ions migrate to a pseudopotential well where the pseudopotential barrier has a magnitude sufficient to trap the ions against the drag force generated from the gas flow.

10. The ion separation device of claim 1, further comprising guard electrodes configured to confine the ions and the gas flow within the two-dimensional array.

11. A mass spectrometer system comprising:

an ion source configured to produce ions;

an ion separation device including a plurality of electrodes arranged in a two-dimensional grid, wherein the plurality of electrodes is configured to create pseudopotential barriers separating a plurality of pseudopotential wells, the pseudopotential barriers increasing in magnitude along a first direction;

a gas supply configured to provide a gas flow along the first direction; and an ion inlet arranged to receive the ions, wherein a drag force applied to the ions by the gas flow is opposed by a pseudopotential gradient of the plurality of electrodes; and a mass analyzer configured to measure a mass to charge ratio of the ions.

12. The mass spectrometer system of claim 11, further comprising an RF supply configured to provide RF voltages to the plurality of electrodes.

13. The mass spectrometer system of claim 12, wherein the RF supply is configured to supply RF voltages of increasing amplitude along the first direction.

14. The mass spectrometer system of claim 11, wherein the spacing between electrodes in the first direction, the spacing between rows of the two-dimensional grid, the pitch of the electrodes, the width of the electrodes or any combination thereof changes along the first direction to achieve the increasing magnitude of the pseudopotential barriers.

15. The mass spectrometer system of claim 11, wherein the ions equilibrate within the ion separation device such that the ions migrate to a pseudopotential well where the pseudopotential barrier has a magnitude sufficient to trap the ions against the drag force generated from the gas flow.

16. The mass spectrometer system of claim 11, wherein the ion separation device further includes guard electrodes configured to confine the ions and the gas flow within the two-dimensional array.

17. The mass spectrometer system of claim 16, wherein the guard electrodes are further configured to eject ions from the two-dimensional array in a direction parallel to a major axis of the electrodes and orthogonal to the gas flow by applying a DC pulse.

18. The mass spectrometer system of claim 11, further comprising a DC supply configured to provide a DC voltage to the plurality of electrodes.

19. The mass spectrometer system of claim 18, wherein the DC supply is configured to apply a DC gradient to eject ions from the two-dimensional array.

20. A method of separating ions comprising:

providing RF potentials to a plurality of electrodes arranged in a two-dimensional grid such that pseudopotential barriers separating a plurality of pseudopotential wells are formed, the pseudopotential barriers increasing in magnitude along a first direction;

supplying a gas flow through the two-dimensional grid in the first direction;

injecting ions into the two-dimensional grid; and separating the ions within the two-dimensional grid wherein a drag force applied by the gas flow is opposed by a pseudopotential gradient of the plurality of electrodes.

21. The method of claim 20, further comprising equilibrating ions within the two-dimensional grid such that ions become trapped in one of the pseudopotential wells where the pseudopotential barrier has a magnitude sufficient to trap the ions against the drag force generated from the gas flow.

22. The method of claim 20, further comprising maintaining an operating gas pressure within the two-dimensional grid of between about $10^{-4}$ Torr and about $10^{2}$ Torr.

23. The method of claim 20, wherein the drag force is a function of the collisional cross section of the ions.

24. The method of claim 20, wherein the gas velocity is between about 10 m/s and about 200 m/s.

25. The method of claim 20 wherein the pseudopotential barrier is a function of the mass-to-charge ratio.

26. The method of claim 20, wherein movement of the ions through the two-dimensional grid is a function of collisional cross section and mass-to-charge ratio.

27. The method of claim 26, wherein movement of the ions through the two-dimensional grid is further dependent upon a gas velocity and a gas viscosity.

28. The method of claim 20, further comprising ejecting the ions from the two-dimensional grid in a direction parallel to a major axis of the electrodes and orthogonal to the gas flow.

29. The method of claim 28, wherein ejecting the ions includes ejecting the ions substantially simultaneously from two or more the plurality of pseudopotential wells.

* * * * *